United States Patent [19]

Lambert et al.

[11] Patent Number: 4,577,476

[45] Date of Patent: Mar. 25, 1986

[54] LOW WET PICKUP FABRIC FINISHING APPARATUS

[75] Inventors: Allan H. Lambert, Metairie; Esmond J. Keating, New Orleans; Gerald B. Verburg, Metairie, all of La.

[73] Assignee: The United States of America as represented by the Secretary of Agriculture, Washington, D.C.

[21] Appl. No.: 636,451

[22] Filed: Jul. 31, 1984

[51] Int. Cl.[4] ..... D06B 5/08

[52] U.S. Cl. ..... 68/5 D

[58] Field of Search ..... 68/5 R, 5 B, 5 D, 5 E, 68/6, 200, 205 R; 118/325, 326; 15/306 A; 239/428; 261/79 R, 79 A

[56] References Cited

U.S. PATENT DOCUMENTS 174,308 2/1876 Scrimgeour ..... 68/6

1,907,429 5/1933 Masland ..... 68/5 D X 4,137,045 1/1979 Brugman ..... 68/5 D X 4,309,456 1/1982 Lock ..... 118/326 X

FOREIGN PATENT DOCUMENTS 2942528 4/1981 Fed. Rep. of Germany ..... 118/325

*Primary Examiner*—Philip R. Coe

*Attorney, Agent, or Firm*—M. Howard Silverstein; David G. McConnell; Raymond C. Von Bodungen

[57] ABSTRACT

An apparatus for applying atomized spray solution to fabric to produce a low wet pickup, uniformly finished fabric is disclosed. A chamber, into which solution is sprayed as an atomized spray cloud, is fitted with means for adding air and an opening through which the cloud exits into contact with a fabric that absorbs the solution and allows the air to pass through. Means for recycling unused solution is also provided.

10 Claims, 2 Drawing Figures

LOW WET PICKUP FABRIC FINISHING APPARATUS

BACKGROUND OF THE INVENTION

1. Field of the Invention

This invention relates to a fabric finishing apparatus.

2. Description of the Prior Art

Heretofore, wet pickup finishing has been accomplished by means of spraying, immersion, padding, foam application, engraved roll, kiss roll, loop transfer and knife coating. All have inherent disadvantages in achieving the desired low wet pickup sought by industry to achieve energy conservation, reliability and uniformity of coating.

Direct spray applications for low wet pickup have been utilized. However, these direct spray applications met with little commercial success because of several problems involved in spraying solutions directly on fabric. Some of these problems are:

Direct spraying of fabric requires moving the fabric directly through a spray chamber. Volume distribution, from side to side using a flat spray produces erratic results. Pneumatic and rotary spraying methods and apparatus produce patterns with serious overlapping. The resultant fabric is one of unreliable distribution.

SUMMARY OF THE INVENTION

This invention relates to an apparatus used to apply atomized spray solutions onto fabric in order to achieve a uniform, low wet pickup finished fabric product. An atomization. chamber is fitted with spraying means which mixes a solution with air and sprays a cloud of atomized solution particles into the chamber. An opening is provided in the chamber through which the atomized cloud exits due to internal air pressure.

The fabric to be treated is juxtaposed across this exit opening so that when the cloud of spray exits, the solution is absorbed by the fabric as the air passes through. The resultant fabric has a uniform finish not heretofore achieved and is produced at lower energy costs.

DESCRIPTION OF THE PREFERRED EMBODIMENTS

Wet pickup is defined as the weight of solution absorbed by a fabric divided by the original dry fabric weigh times 100, giving the result in percent of wet pickup. For purposes of the present invention, the term low wet pickup applies to any fabric with a wet pickup in the range of one to forty percent.

Figure 1:
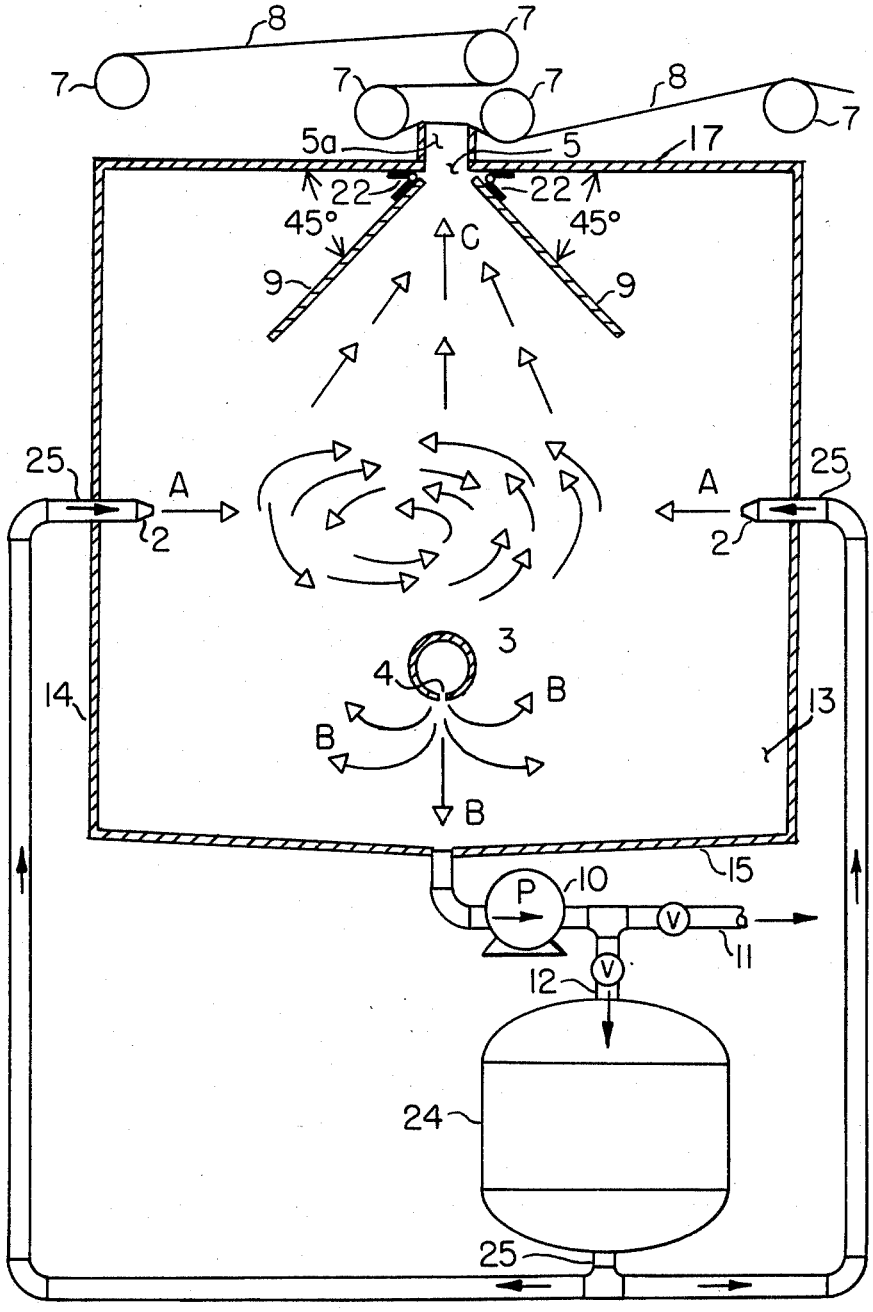
FIG. 1 is a cross section of the atomization chamber showing the salient parts and recycling means.
Figure 2:
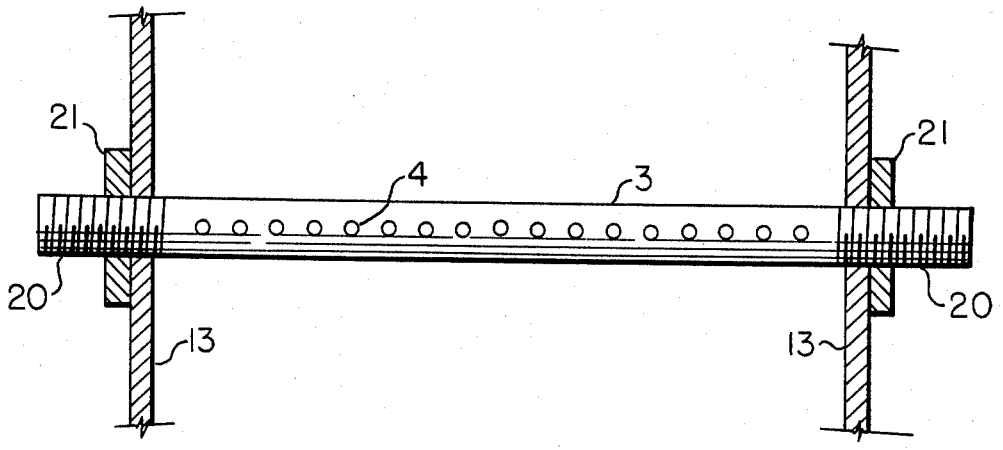
FIG. 2 is a detail of the air manifold showing air holes and means for attachment.

Referring now to FIG. 1 wherein a chamber 1 is fitted with two spray nozzles 2 which receive external air and solution from storage tank 24 through feed line 25 (FIG. 3) are mounted to the center of opposing sides 14 (FIG. 1) of chamber 1. Pneumatic type external mix, air/solution, spray nozzles which produce a plane of spray parallel to bottom side 15 of chamber 1 are used in the present invention, but any nozzles capable of uniform spray patterns are acceptable. By locating nozzles 2 on opposing sides 14 of chamber 1, uniform mixing is achieved in the center of chamber 1. When air and solution are sprayed into chamber 1, in the direction of arrows A, the solution is atomized into a cloud of very fine solution particles. Additional air is supplied to chamber 1 through manifold 3 which is located near and traverses substantially the full width of the center of bottom side 15 of chamber 1. Manifold 3 must be positioned below spray nozzles 2 to accomplish uniform mixing. This additional air increases the velocity of the atomized spray particles, aids in transporting the spray particles (cloud) through opening 5 and brings the solution into contact with fabric 8. Manifold 3 (FIG. 2) is constructed with a plurality of exit air holes 4 spaced laterally along the bottom side of the full length of manifold 3. Exit air holes 4 are thus directed toward bottom side 15 of chamber 1. Air exiting holes 4 strikes side 15 of chamber 1 and returns in the direction as shown by arrows B (FIG. 1). This additional air aids in uniformly mixing the atomized solution. cloud in the center of chamber 1. Air is fed into manifold 3 through both ends by external means (not shown) since both ends of manifold 3 are open ended. The ends of manifold 3 are mounted to and through opposing sides 13 which are adjacent to nozzle mounting sides 14 of chamber 1. While manifold 3 is shown as mounted to and through sides 13 by means of threaded ends 20 and nuts 21, (FIG. 2) obviously any means of attaching manifold 3 to and through sides 13 is acceptable.

Exit opening 5 (FIG. 1) is located in the center of top side 17 of chamber 1. The cross sectional configuration and area of opening 5 is determined by: the configuration of fabric 8 which is to be finished; the velocity desired for solution particles to strike fabric 8; and, the low wet pickup concentration of solution per square inch of fabric needed.

In the preferred embodiment of the present invention an exemplary 2"×12" rectangular opening is used to interface a 12" width moving fabric 8. The cross sectional area of opening 5 can be narrowed or expanded to vary the velocity and volume of solution which exits opening 5 and strikes fabric 8 which is juxtaposed to and moving past opening 5 on external rollers 7 at a controlled rate of speed.

Since friction between moving fabric 8 and chamber 1 is very undesirable, opening **5*a* is the vertical extension of opening 5 and is approximately 2" above the external surface of side 17. Rollers 7, on opposite sides of extended opening 5*a*, are positioned to put fabric 8 in tension when moving across the external periphery of extended opening 5*a*. This is to avoid loss of solution to the surrounding environment and bring the solution cloud into efficient contact with fabric 8. Thus, the two rollers 7 which are located on opposite sides of extended opening 5*a* are positioned with the maximum lowest point of circumference slightly below the top plane of the external surface of extended opening 5*a*. Thus, when fabric 8 is moved between rollers 7 and the external periphery of extended opening 5*a* it is placed in a slight tension and forms a tight seal over the end of extended opening 5*a*, whereby fabric 8 efficiently intercepts the solution cloud as it exits extended opening 5*a***.

Baffles 9 are adjustably attached to two sides of the internal periphery of opening 5 by hinges 22 and are provided at an angle of 45° with respect to top side 7 to more efficiently direct the flow of atomized solution particles to and through opening 5 in the direction as shown by arrows C where the solution is absorbed by fabric 8 which is juxtaposed externally to opening 5 or 5a. Baffles 2 are the full length of the opening which is 12" long.

In the preferred embodiment the rate at which fabric 8 moves past opening 5 can be controlled to vary the amount of solution absorbed by fabric 8. Decreasing the speed of fabric 8 increases the amount of solution brought into contact with fabric 8 and consequently, the amount of solution absorbed per square inch of fabric can be increased. Increasing the speed of fabric 8 decreases the amount of solution brought into contact with fabric 8 and consequently the amount of solution absorbed by fabric 8 can be decreased. Therefore, accurate concentrations of wet pickup per square inch of treated fabric can be accurately controlled.

Reference number 10 designates a pump which is attached externally to drain bottom side 15 of chamber 1. Pump 10 can therefore collect and recycle unused solution. For example, unused solution collecting on bottom side 15 is drained by pump 10 and either recycled through line 12 back to solution storage tank 24 which feeds spray nozzles 2 or pumped through line 11 to a disposal drain or pump (not shown) for disposition.

Obviously, chamber 1 can be of any size or shape which will efficiently accomodate the above detailed description. In the present invention an exemplary atomization chamber, 30" high, 45" long and 15" wide is used. Naturally, the materials of construction must be compatable with any chemical used in the processing of the fabric. The present invention utalizes a stainless steel as exemplary material of construction to accomodate a durable press treatment process.

Details for an exemplary the durable press formula are as follows: crosslinker, dimethyloldihydroxyethyleneurea; catalyst, $MgCl_2.6H_2O$/citric acid (50/50); wetting agent, Triton x-100; softener, Seycolube 0-19, and solvent (water).

It is further obvious that negative pressure means (not shown) can be provided to draw the solution cloud from chamber 1 through opening 5 and into contact with fabric 8 as an alternative to the positive pressure description set forth above.

Flow rates of solution through the nozzles are acceptable in the range of from about 50 ml/min to 350 ml/min with an exemplary rate of 100 ml/min.

Air pressure to nozzles 2 can be varied to control the size of solution spray particle. The higher the nozzle air rate the smaller the particle of solution in the cloud and consequently the greater the amount of solution carried by air into contact with fabric 8. Air pressure supplied to nozzles 2 is acceptable in the range of from about 2 cuft/min to 8 cuft/min with the exemplary rate at 6 cuft/min.

Increasing the air flow in manifold 3 increases the rate of wet pickup on fabric 8. The higher the air velocity flowing through exit opening 5, the larger the quantity of solution absorbed by fabric 8 since more particles are picked up. Air supplied to manifold 3 is acceptable in the range of from about 15 cuft/min to 60 cuft/min with the exemplary air rate being 60 cuft/min (Given in SCFM).

Slot widths are acceptable in the range of from about 1"×12" to about 6"×12" with 2"×12" being an exemplary cross sectional area when interfacing with a 12" wide fabric.

Fabric speeds are acceptable at approximately 0.2 yd/min to 2 yds/min with exemplary speeds being 1 yd/min.

The angle of baffles 9 with respect to the plane of top side 17 is acceptable from about 30° to 60° with 45° being exemplary.

We claim:

1. An apparatus for applying atomized spray solutions to fabric to produce low wet pickup, uniformly finished fabrics comprising:

(a) a chamber;

(b) means for spraying solution mixed with air into said chamber to form a cloud of atomized solution spray particles;

(c) a manifold with open ends mounted to and through opposing chamber sides so that air can be externally fed through the open ends thereof and out of a plurality of exit air holes which are located laterally along the side of the manifold facing the bottom side of the chamber so that air exiting the holes strikes the bottom side of the chamber and returns to mix the atomized spray solution in the center of the chamber as well as incresae the internal air pressure; and, (d) an opening in said chamber through which said cloud, moved by internal air pressure, exits and contacts fabric juxtaposed across the external periphery of said opening, said fabric adsorbing the solution particles on contact and allowing air to pass through, thereby producing a low wet pickup, uniformly finished fabric.

2. The apparatus of claim 1 including baffles adjustably attached to the internal periphery of the exit opening, said baffles to direct the cloud through the exit opening.

3. The apparatus of claim 2 including means for externally extending the exit opening.

4. The apparatus of claim 3 including means for externally moving the fabric across the external periphery of the extended opening.

5. The apparatus of claim 4 wherein the means for moving the fabric across the external periphery of the extended opening include a plurality of rollers, two of said rollers positioned on opposing sides of the extended opening so that the lowest point on the circumference of the rollers is slightly lower than the plane of the external periphery of the extended opening thereby placing the fabric in tension as it moves past the rollers and across the extended opening.

6. The apparatus of claim 3 including a means for recycling unused spray solution.

7. The apparatus of claim 6 wherein the recycling means comprises: a pump attached to the bottom of the chamber to drain unused solution a return line to recycle said unused solution to the storage tank.

8. The apparatus of claim 2 including a means for moving the fabric across the external opening.

9. The apparatus of claim 8 wherein the means for moving the fabric across the external opening include a plurality of rollers.

10. The apparatus of claim 2 wherein the baffles are hinged to the internal periphery of the exit opening, said baffles angled at 45° with respect to the plane of the top side of the chamber.

* * * * *